United States Patent [19]

Sunshine

[11] Patent Number: 4,917,644

[45] Date of Patent: Apr. 17, 1990

[54] MAGNETIC TOY AND APPAREL

[76] Inventor: Philip Sunshine, 1997 Milboro Dr., Potomac, Md. 20854

[21] Appl. No.: 395,682

[22] Filed: Aug. 18, 1989

[51] Int. Cl.[4] ..... A63H 33/00; A63H 33/26; A63H 1/24; A63F 9/00

[52] U.S. Cl. ..... 446/26; 446/129; 446/138; 446/242; 273/DIG. 17; 273/1 GD

[58] Field of Search ..... 446/26, 27, 28, 129, 446/130, 131, 132, 133, 134, 135, 136, 137, 138, 168, 170, 242, 265, 219; 273/DIG. 17, DIG. 18, DIG. 19, 1 GA, 1 GD, 1 M

[56] References Cited

U.S. PATENT DOCUMENTS

| | | | |
|---|---|---|---|
| 2,994,984 | 8/1961 | Luchsinger | 446/132 |
| 3,098,316 | 7/1963 | McCarthy | 273/DIG. 17 X |
| 3,541,161 | 6/1969 | Lemelson | 446/138 |
| 3,532,340 | 10/1970 | Nardiello | 273/DIG. 19 X |
| 3,626,633 | 12/1971 | Meyer | 446/132 |
| 3,868,786 | 3/1975 | Lippe et al. | 446/28 |
| 4,531,923 | 7/1985 | Lohr | 446/137 X |
| 4,715,839 | 12/1987 | Ford et al. | 446/28 |

FOREIGN PATENT DOCUMENTS

| | | | |
|---|---|---|---|
| 521438 | 2/1956 | Canada | 446/242 |
| 2155813 | 11/1971 | Fed. Rep. of Germany | 273/1 M |
| 3201438 | 7/1983 | Fed. Rep. of Germany | 273/1 M |
| 2029246 | 3/1980 | United Kingdom | 446/138 |
| 2123704 | 2/1984 | United Kingdom | 446/138 |

OTHER PUBLICATIONS

"Space Trix", Fishlore & Co., Chicago, IL, Mar., 1965.
"Rubber Magnet", Mayer Studios, Inc., Akron, Oh., 1950.
"Plastics that Glow", Modern Plastics, Oct., 1948.

*Primary Examiner*—Mickey Yu
*Assistant Examiner*—D. Neal Muir
*Attorney, Agent, or Firm*—Finnegan, Henderson Farabow, Garrett & Dunner

[57] ABSTRACT

This magnetic toy includes a figure which may roll, where a part of the figure is magnetized with poles forming a magnetic force line around the figure. Also included is a belt with poles disposed along the length, the poles forming a magnetic force line. The figure is placed on the belt with the magnetic forces adhering the figure but allowing it rolling movement along the belt. The belt may be used around a person's extremities or torso. The belt may be incorporated into an article of apparel which does not have surface obstructions that would prevent rolling of the figure along the track of the belt.

24 Claims, 2 Drawing Sheets

FIG. 1
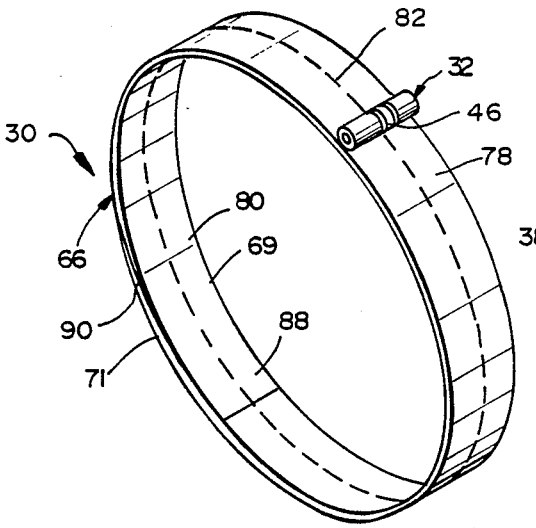
FIG. 2
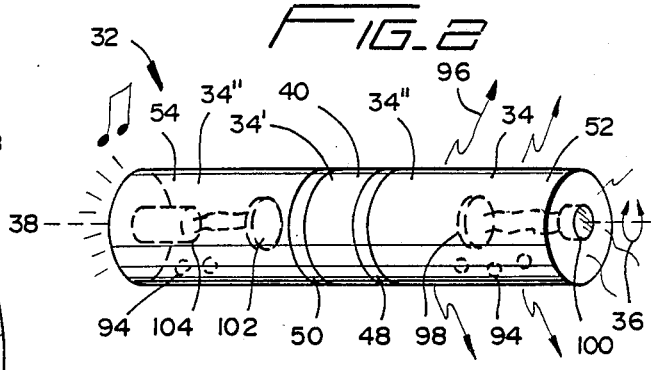
FIG. 3
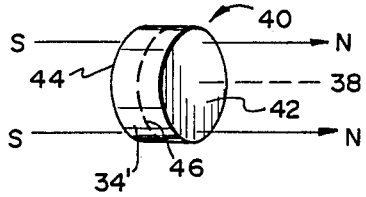
FIG. 6
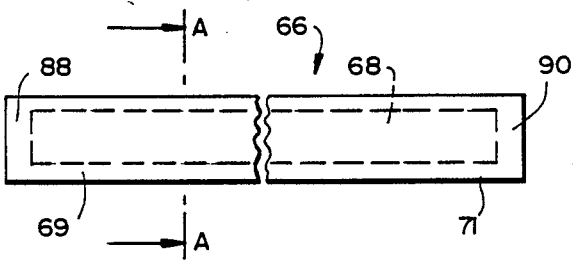
FIG. 4
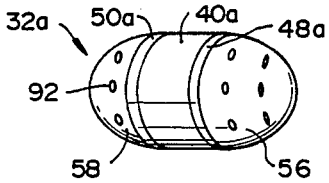
FIG. 7
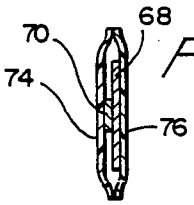
FIG. 5
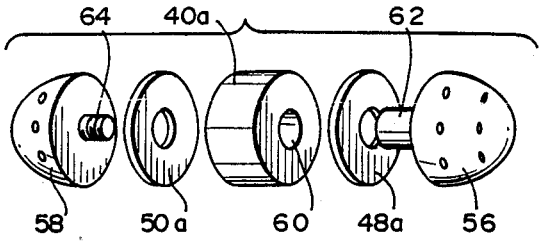
FIG. 8
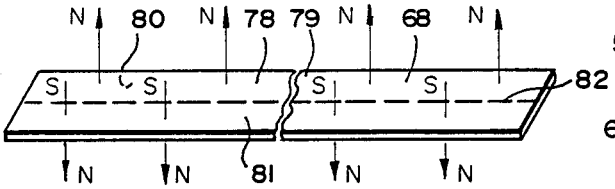
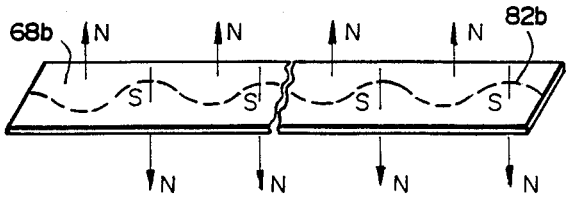
FIG. 10
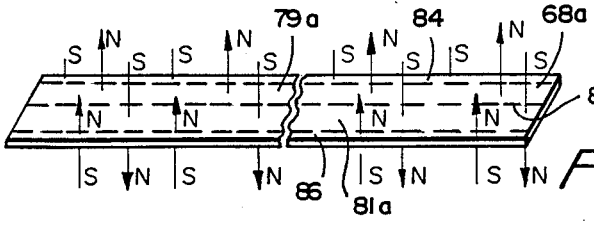
FIG. 9

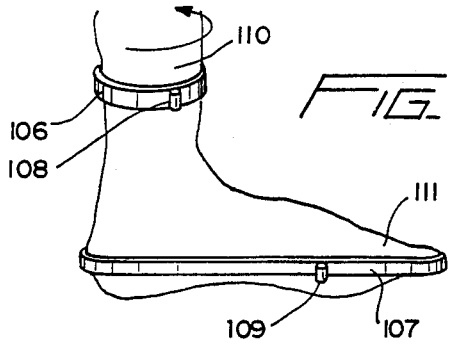
FIG. 11
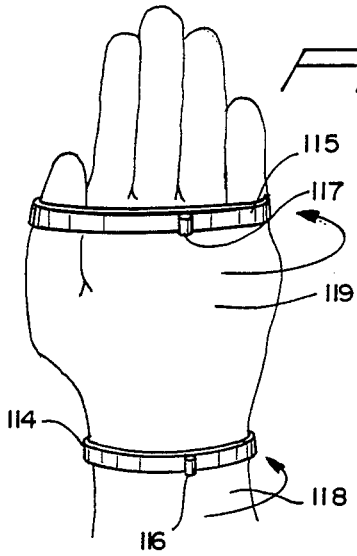
FIG. 12
FIG. 13
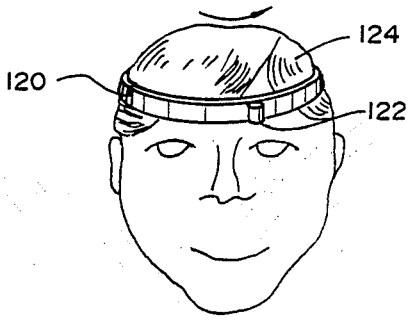
FIG. 14
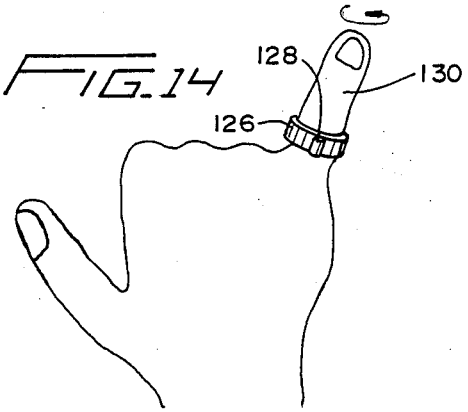
FIG. 15
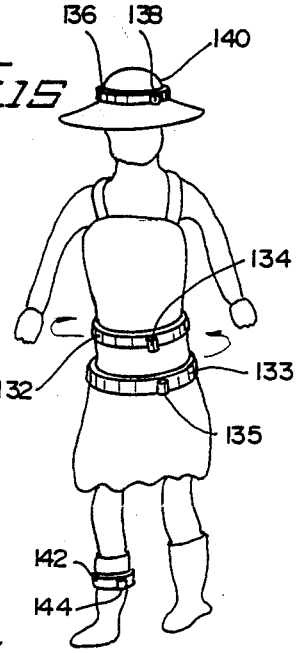
FIG. 17
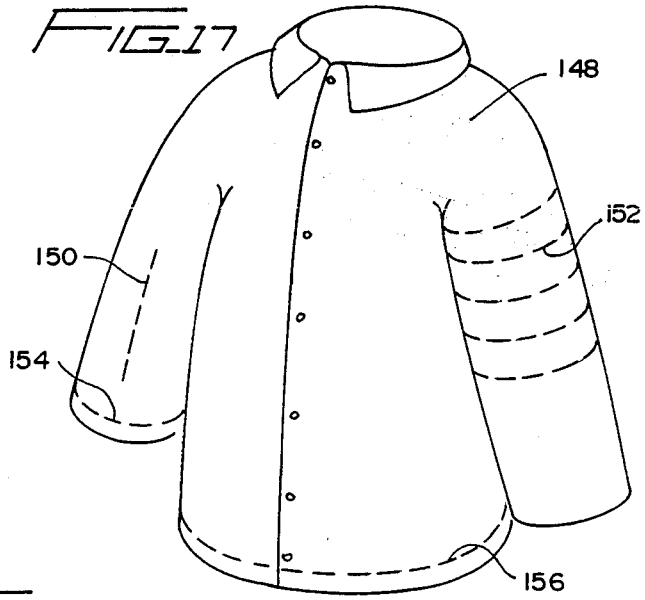
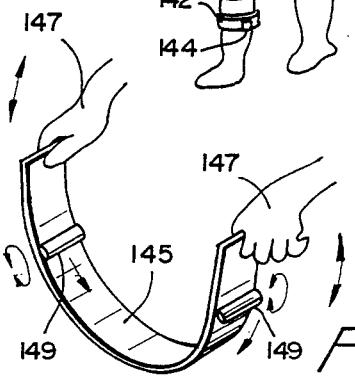
FIG. 16

MAGNETIC TOY AND APPAREL

BACKGROUND OF THE INVENTION

The present invention relates to magnetic toys and a method of using magnetic toys.

Conventional magnetic toys include wheeled vehicles and tracks on which the wheeled vehicles roll. By forming a wheeled vehicle and track from materials which magnetically attract each other, the wheeled vehicle is permitted to roll along the track while being magnetically attracted to the track. Guardrails and grooved surfaces are used to guide the wheeled vehicle along the track and prevent it from veering off the side of the track.

Although suitable for the purposes intended, such conventional magnetic toys have a number of drawbacks which have limited their appeal and commercial viability. Such drawbacks include the considerable cost and complexity involved in manufacturing conventional magnetic toys. Also, conventional magnetic toys generally have been limited to a single use and do not allow for use in new and creative ways. In addition, there have been limitations on the use of conventional magnetic toys due to undesirable friction between the components of those toys, and insufficient magnetic attraction between the components of those toys.

SUMMARY OF THE INVENTION

Accordingly, it is an object of the present invention to provide a new magnetic toy which operates in a different manner than other magnetic toys, and in particular, includes a figure that can be made to roll around various parts of a user, like the motion of a hula hoop.

It is also an object of the present invention to provide a magnetic toy which has the capability of being used in a number of new and creative ways.

It is another object of the present invention to have an improved magnetic attraction between the figure and the surface on which the figure rolls.

It is an additional object of the present invention to guide the figure along the surface while having a reduction in friction between the figure and the guiding element.

It is a further object of the present invention to provide a magnetic toy which is simpler and less expensive to manufacture and use than conventional magnetic toys.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, there is provided a magnetic toy. The magnetic toy includes a figure having an outside surface which permits the figure to roll in an angular direction. At least part of the figure has two opposite magnetic poles running parallel to each other along the figure surface in the angular direction and forming a magnetic force line between the two opposite magnetic poles in the figure.

The magnetic toy also includes a belt having an outside surface which permits the figure to roll. At least part of the belt has two opposite magnetic poles running parallel to each other along the belt surface and forming a magnetic force line along the belt surface between the two opposite magnetic poles in the belt. The magnetic force line in the belt constitutes means for attracting and holding the figure to the belt, permitting the figure to roll along the belt, orienting the figure relative to the belt by aligning the magnetic force line of the figure with the magnetic force line of the belt, and guiding the figure along a path on the belt defined by the magnetic force line of the belt by keeping the magnetic force line of the figure aligned with the magnetic force line of the belt while the figure rolls along the belt.

It is preferable that the magnetic belt is flexible, and has two end portions which are attachable to each other. It is also preferable that means are provided on the end portions of the belt for providing the outside surface of the belt with a smooth and continuous area where and when the end portions are attached.

Also in accordance with the purposes of the invention as embodied and described herein, there is provided a method of using a magnetic toy. A belt having a magnetic force line is secured around a portion of a user. A magnetic figure having a magnetic force line is positioned proximate to the belt, and the magnetic force line of the figure is aligned with the magnetic force line of the belt. The user moves in a path which rolls the figure along the magnetic force line of the belt. It is preferable that the user moves in a path which rolls the figure in a circulating endless path along the magnetic force line of the belt.

BRIEF DESCRIPTION OF THE DRAWINGS

The accompanying drawings, which are incorporated in and constitute a part of the specification illustrate presently preferred embodiments of the invention, and together with the general description given above and the detailed description of the preferred embodiments given below, serve to explain the principles of the invention.

FIG. 1 is a perspective view of a magnetic toy incorporating the teachings of the present invention.

FIG. 2 is a perspective view of a first component of the magnetic toy shown in FIG. 1.

FIG. 3 is a perspective view of an element of the component shown in FIG. 2.

FIG. 4 is a perspective view of a second embodiment of the component shown in FIG. 2.

FIG. 5 is an exploded perspective view of the component shown in FIG. 4.

FIG. 6 is a front view of a second component of the magnetic toy shown in FIG. 1.

FIG. 7 is a cross section view taken along line A-A of FIG. 6.

FIG. 8 is a perspective view of an element of the component shown in FIG. 6.

FIG. 9 is a perspective view of a second embodiment of the element shown in FIG. 8.

FIG. 10 is a perspective view of a third embodiment of the element shown in FIG. 8.

FIGS. 11–17 are perspective views of various magnetic toys such as that shown in FIG. 1 secured around various portions of a user and also demonstrating methods of using the magnetic toy.

DESCRIPTION OF THE PREFERRED EMBODIMENTS

Reference will now be made in detail to the present preferred embodiments of the invention as illustrated in the accompanying drawings.

In accordance with the present invention, there is provided a magnetic toy. The magnetic toy includes a figure having an outside surface which permits the figure to roll in an angular direction. As shown in FIG. 1, the magnetic toy is generally designated by the numeral 30 and the figure is generally designated by the numeral 32. In the embodiment shown in FIG. 2, FIG. 32 has a cylindrical outside surface 34 which permits the figure to roll in an angular direction 36 about its central axis 38.

According to the present invention, at least part of the figure has two opposite magnetic poles running parallel to each other along the figure surface in the angular direction and forming a magnetic force line between the two opposite magnetic poles in the figure.

In the embodiment shown in FIGS. 2 and 3, FIG. 32 includes a central magnet 40. Magnet 40 preferably is made with an energy product of 3.0 or greater. This can be done with a flexible magnet or with an Alnico magnet or with a ceramic magnet Grade V. In this embodiment, magnet 40 is a solid cylinder of material which can be magnetized and which is magnetized through its thickness with one pole on each axial side. As shown in FIG. 3, the north pole points out from right axially side 42 while the south pole points out from left axial side 44. Such a magnetic arrangement results in a force line 46 in the middle of the cylindrical outside surface 34' of magnet 40.

It is preferable that the figure includes a disk of magnetically affectable material attached to each of the axial sides of the central magnet. As shown in FIG. 2, the disk of magnetically affectable material on each of the two axial sides 42 and 44 of magnet 40 are steel disks 48 and 50, made of sheet metal. Although steel disks are presently preferred, any magnetically affectable material such as magnetized material or para-magnetic material may be used. Disks 48 and 50 are glued to magnet 40. Disks 48 and 50 of magnetically affectable material serve to strengthen the magnetic force line 46.

It is preferable that a lightweight stabilizing extension is attached to each of the axial sides of the central magnet. As embodied and shown in FIG. 2, the stabilizing extensions are plastic cylindrical extensions 52 and 54 having cylindrical outside surfaces 34''. Extensions 52 and 54 are glued to steel disks 48 and 50.

As embodied in FIGS. 4 and 5, it is preferable that the magnet is a central annular shaped magnet **40*a* having central aperture 60, and the stabilizing extensions are plastic hemispherical extensions 56 and 58 which include integral tabs 62 and 64. Tabs 62 and 64 orient and secure together the components of FIG. 32*a*. They extend through central aperture 60 of magnet 40*a* and the central apertures of disks 48*a* and 50*a* to facilitate assembling extensions 56 and 58, and disks 48*a* and 50*a* to magnet 40*a*. Disks 48*a* and 50*a* are similar to disks 48 and 50 except that they include a central aperture. Tabs 62 and 64** may be threaded to screw into each other.

According to the present invention, there is provided a belt having a outside surface which permits the figure to roll. As shown in FIG. 1, the belt is generally designated by the numeral 66. Belt 66 is preferably flexible and includes a flexible magnetic strip 68, such as the Korseal magnet, which is a flexible magnet made of a vinyl material with tiny magnetic particles embedded in the material. Flexible magnetic strip 68 preferably has an energy product of at least 1.0, a thickness of about 0.06 inches and a width of about 0.50 inches. Two layers of vinyl 74 and 76, such as vinyl tape, form the outside layer of belt 66 as shown in FIG. 7.

According to the present invention, at least part of the belt has two magnetic poles running parallel to each other along the belt surface and forming a magnetic force line along the belt surface between the two opposite magnetic poles in the belt.

As shown in FIG. 8, flexible magnetic strip 68 is magnetized with two poles running parallel to the length of the belt, so that the principal obverse face 78, shown in FIG. 8, has a north pole along its upper half and a south pole along its lower half. The north pole points out from the upper half of the principal obverse face 78 and the south pole points out from the lower half of the principal obverse face 78.

Flexible magnetic strip 68 is magnetized through its thickness so the direction of the magnetic fields of the principal reverse face 80 are the opposite of the corresponding portions of principal obverse face 78. Such a magnetic arrangement results in a magnetic force line 82 which generally extends along the center of the principal obverse face 78 and the principal reverse face 80.

According to one aspect of the present invention, it is preferable that a flexible sheet of magnetically attractable material 70 underlies magnetic strip 68 as shown in FIG. 7. Although steel sheet metal is presently preferred, any magnetically attractable material such as magnetized material or para-magnetic material may be used.

It is preferable that the flexible sheet of magnetically attractable material 70 is thinner and narrower than flexible magnetic strip 68. As shown in FIG. 7, material 70 is about one third the width of magnetic strip 68 and underlies magnetic force line 82 in the center of magnetic strip 68. Material 70 is preferably about the thickness of a typical metal measuring tape. In this embodiment, it is preferable for FIG. 32 to roll on side 76 of belt 66, which is the side proximate to magnetic strip 68 as opposed to the side proximate to the sheet of magnetically attractable material 70. Flexible magnetically attractable material 70 serves to strengthen the magnetic force line 82 of belt 66.

According to one aspect of the present invention, the belt has two edges running generally parallel to the two magnetic poles forming the magneiic force line in the belt, and two additional magnetic poles extending along the two edges of the belt. As shown in FIG. 9, flexible magnet **68*a* has two additional magnetic poles 84 and 86 extending along its edges generally parallel to the two central magnetic poles 79*a* and 81*a*. Additional magnetic poles 84 and 86 point in the opposite direction of the respective adjacent central poles 79*a* and 81*a*. The use of additional magnetic poles 84 and 86 serve to strengthen the magnetic force line 82 of belt 66**.

It is preferable that the magnetic toy includes means on the outside surface of the belt for preventing erosion of the belt and means on the end portions of the belt for providing the outside surface of the belt with a smooth and continuous area where and when the end portions are attached. As shown in FIGS. 1,6 and 7, the means for preventing erosion and the means for providing a smooth and continuous area include a layer of vinyl 74 which covers and extends beyond the edges of principal obverse face 78 and a second layer of vinyl 76 which covers and extends beyond the edges of principal reverse face 80. Layers of vinyl 74 and 76 may for example include strips of vinyl tape which preferably extend at least 0.20 inches beyond the edges of flexible magnet 68. The vinyl preferably should be no thicker than 3 mm. in thickness so as to have minimal interference with the magnetic force.

Extension portions 88 and 90 of vinyl 74 and 76 at the ends of belt 66, as shown in FIGS. 1 and 6, are flexible and can be pushed into place by hand or by the figure to form a smooth and continuous ramp area bridging the bump caused when the end portions 69 and 71 of belt 66 are overlapped and magnetically attached as shown in FIG. 1.

According to the present invention, the magnetic force line in the belt constitutes means for attracting and holding the figure to the belt, permitting the figure to roll along the belt, orienting the figure relative to the belt by aligning the magnetic force line of the figure with the magnetic force line of the belt, and guiding the figure along a path on the belt defined by the magnetic force line of the belt by keeping the magnetic force line of the figure aligned with the magnetic force line of the belt while the figure rolls along the belt.

As shown in FIG. 1, the magnetic fields in the force lines of belt 66 and FIG. 32 attract and hold FIG. 32 to belt 66, permitting FIG. 32 to roll along belt 66 in an endless path around the outside of the loop shown in FIG. 1. The magnetic force field of the magnetic force line 82 of belt 66 causes the magnetic force line 46 of central magnet 40 of FIG. 32 to be oriented so that it overlies and is aligned in parallel with magnetic force line 82 of belt 66. The north side 79 of the magnetic force line 82 of belt 66 is proximate to the south side 44 of magnet 40 of FIG. 32, and the south side 81 of magnetic force line 82 is proximate to the north side 42 of magnet 40 of FIG. 32.

Magnetic force line 82 of belt 66 guides FIG. 32 along a path on belt 66 defined by force line 82 of belt 66 by keeping magnetic force line 46 of FIG. 32 aligned with magnetic force line 82 of belt 66 as FIG. 32 rolls along 66.

According to one aspect of the invention it is preferable that the magnetic force line of the belt zigzags along the longitudinal direction of the belt surface. As shown in FIG. 10, flexible magnet **68*b* is magnetized so that the magnetic force line 82*b* zig-zags along the surface. Such a zig-zag force line 82*b* guides a rolling magnetic figure so that the rolling magnetic figure follows magnetic force line 82*b*** and rolls in a zig-zag pattern along the belt.

It is within the scope of this invention to use magnetic force lines of other various patterns and figures of various shapes to allow the figures to roll in the patterns of the magnetic force line on the belt.

According to one aspect of the invention, it is preferable that the figure includes means for making a whistling sound. As shown in FIG. 4, the means for making a whistling sound include apertures 92 in the surfaces of hemispherical extensions 56 and 58.

According to another aspect of the invention, the figure includes means for making a rattling sound. As shown in FIG. 2, the means for making a rattling sound include pebbles 94 on the inside of cylindrical extensions 52 and 54.

According to still another aspect of the invention, it is preferable that the figure is fluorescent. As shown in FIG. 2, the outside of cylindrical extensions 52 and 54 are coating with a fluorescent substance which radiates light 96. Another embodiment includes using a figure in which the extensions include glow-in-the-dark chemicals which emit light when the chemicals are mixed.

According to another aspect of the invention, the figure includes a power source and a lamp powered by the power source. As shown in FIG. 2, the power source is a watch battery 98 and the lamp is an LED 100 wired to and powered by watch battery 98.

According to an additional aspect of the invention, the figure includes a power source and a musical device powered by the power source. As shown in FIG. 2, the power source is a watch battery 102 and the musical device is a miniature semiconductor chip musical device which plays a tune or beeps. Such semi-conductor chip musical devices are commercially available, and are used, for example, in greeting cards.

According to present invention, there is provided a method of using a magnetic toy. A belt having a magnetic force line is secured around a portion of a user. A magnetic figure having a magnetic force line is positioned proximate to the belt, aligning the magnetic force line of the figure with the magnetic force line of the belt. The portion of the user is then moved in a path which rolls the figure along the magnetic force line of the belt.

As shown in FIG. 11, the belt is an ankle bracelet 106 which is secured around the ankle of the user. A magnetic FIG. 108 is positioned and aligned on belt 106 and the ankle 110 of the user is moved in a circular path, much like a hulahoop movement, which rolls FIG. 108 in a circulating endless path along the magnetic force line of the belt. Belt 107 is shown secured around the shoe or foot 111 and is used with FIG. 109.

As shown in FIG. 12, the belt is a flexible endless loop in the form of a wrist bracelet 114, worn around wrist 118, and the figure is a charm 116. Belt 115 is shown secured around the fingers or hand 119 and is used with FIG. 117.

As shown in FIG. 13, the belt is a flexible headband 120 worn around head 124, and the figure is a medallion 122.

As shown in FIG. 14, the belt is a rigid endless loop in the form of a ring 126 worn around finger 130 and the figure is a stone-like object 128.

As shown in FIG. 15, a belt 132 worn around the mid section of the user, and the figure is an ornament 134. Another belt 133 is shown worn around the hips and used with FIG. 135. Yet another belt is a hatband 136, and the figure is a decorative object, perhaps with a feather 138, and is worn around a hat 140 placed on the head of the user. A further belt 142 is worn around a boot 146 with a figure such as bangle 144.

As shown in FIG. 16, the ends of belt 145 may be held in the user's hands 147, and FIG. 149 can be made to roll above or below the belt.

It is within the scope of this invention that the belt, when constructed in a form having ends, can be adjusted in size by overlapping the ends of the belt over greater or lesser distances. As a result, the belt may be made to fit various users as well as various portions of a user. For example, as shown in FIG. 15 the belt can be adjusted to fit around hat, boot, midsection or hips of the user.

According to another aspect of the invention, there is provided apparel having an outside surface which permits the figure to roll along a magnetic force line. As shown in FIG. 17, the apparel includes a jacket 148 having an outside shell of material under which flexible magnetic material such as a magnetic belt is attached. For example, one sleeve has a magnetic force line 150 which runs along the length of the sleeve. The other sleeve has a magnetic force line 152 which spirals around the sleeve. Other alternatives are a magnetic force line 154 which encircles the cuff or 156 which encircles the bottom of the jacket. Magnetic figures, such as those described above may be placed on the magnetic force line and rolled along the magnetic force lines on the apparel for fun or as a fashion statement.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concepts as defined by the appended claims and their equivalents.

I claim:

1. A magnetic toy comprising:

a figure having an outside surface which permits the figure to roll in an angular direction, at least part of the figure having two opposite magnetic poles running parallel to each other along the figure surface in the angular direction and forming a magnetic force line between the two opposite magnetic poles in the figure;

a magnetic belt having an outside surface which permits the figure to roll, at least part of the belt having two opposite magnetic poles running parallel to each other along the belt surface and forming a magnetic force line along the belt surface between the two opposite magnetic poles in the belt, said magnetic force line in the belt constituting means for attracting and holding the figure to the belt, permitting the figure to roll along the belt, orienting the figure relative to the belt by aligning the magnetic force line of the figure with the magnetic force line of the belt, and guiding the figure along a path on the belt defined by the magnetic force line of the belt by keeping the magnetic force line of the figure aligned with the magnetic force line of the belt while the figure rolls along the belt.

2. The magnetic toy of claim 1 wherein the magnetic belt is flexible.

3. The magnetic toy of claim 1 wherein the magnetic belt is flexible, extends in a longitudinal direction between two end portions, and said end portions are attachable to each other.

4. The magnetic toy of claim 3 including means on the end portions of the belt for providing the outside surface of the belt with a smooth and continuous area where and when the end portions are attached.

5. The magnetic toy of claim 4 wherein the means for providing a smooth and continuous area is a covering attached to and extending beyond the end portions of the belt.

6. The magnetic toy of claim 1 wherein the magnetic belt has obverse and reverse faces and said magnetic force line extends along both the obverse and reverse faces.

7. The magnetic toy of claim 1 wherein the belt generally extends in a longitudinal direction and the magnetic force line generally extends along a central area of the belt surface.

8. The magnetic toy of claim 1 wherein the belt extends in a longitudinal direction and the magnetic force line of the belt zig-zags along the longitudinal direction on the belt surface.

9. The magnetic toy of claim 1 including means on the outside surface of the belt for preventing erosion of the belt.

10. The magnetic toy of claim 1 wherein the magnetic belt includes a magnet and a sheet of magnetically attractable material underlying the magnet.

11. The magnetic toy of claim 1 wherein the belt has two edges running generally parallel to the two magnetic poles forming the magnetic force line in the belt, and two additional magnetic poles extending along the two edges of the belt.

12. The magnetic toy of claim 1 wherein the figure includes a central magnet having a cylindrical outside surface.

13. The magnetic toy of claim 1 wherein the figure includes a central annular shaped magnet with two axial sides.

14. The magnetic toy of claim 1 wherein the figure includes a central magnet having two axial sides and a disk of magnetically attractable material attached to each of the axial sides of the central magnet.

15. The magnetic toy of claim 1 wherein the figure includes a central magnet having two axial sides and a lightweight stabilizing extension attached to each of the axial sides of the central magnet.

16. The magnetic toy of claim 15 wherein the figure includes a disk of magnetically attractable material attached between each side of the central magnet and the stabilizing extension.

17. The magnetic toy of claim 15 wherein the stabilizing extensions have cylindrical outside surfaces.

18. The magnetic toy of claim 15 wherein the stabilizing extensions have hemispherical outside surfaces.

19. The magnetic toy of claim 15 wherein the figure includes means for making a whistling sound.

20. The magnetic toy of claim 15 wherein the figure includes means for making a rattling sound.

21. The magnetic toy of claim 15 wherein the figure is florescent.

22. The magnetic toy of claim 15 wherein the figure includes a power source and lamp powered by the power source.

23. The magnetic toy of claim 15 wherein the figure includes a power source and a musical device powered by the power source.

24. Apparel with a decorative figure comprising:

a decorative figure having an outside surface which permits the figure to roll in an angular direction, at least part of the figure having two opposite poles running parallel to each other along the figure surface in the angular direction and forming a magnetic force line between the two opposite magnetic poles of the figure;

apparel having an outside surface which permits the decorative figure to roll, at least part of the apparel having two opposite magnetic poles running parallel to each other along the apparel surface and forming a magnetic force line along the apparel surface between the two opposite magnetic poles in the apparel, said magnetic force line in the apparel constituting means for attracting and holding the figure to the apparel, permitting the figure to roll along the apparel, orienting the figure relative to the apparel by aligning the magnetic force line of the figure with the magnetic force line of the apparel, and guiding the figure along a path on the apparel defined by the magnetic force line of the apparel by keeping the magnetic force line of the figure aligned with the magnetic force line of the apparel while the figure rolls along the apparel.

* * * * *

UNITED STATES PATENT AND TRADEMARK OFFICE

CERTIFICATE OF CORRECTION

PATENT NO. : 4,917,644

DATED : April 17, 1990

INVENTOR(S) : Philip Sunshine

It is certified that error appears in the above-identified patent and that said Letters Patent is hereby corrected as shown below:

Column 3, lines 13, 22, delete "FIG. 32" and insert --figure 32--.

Column 3, line 57, delete "FIG. 32a" and insert --figure 32a--.

Column 4, line 43, delete "FIG. 32" and insert --figure 32--.

Column 5, lines 29 (both occurrences), 30, 34, 38, 40, 41, 43, 44, delete "FIG. 32" and insert --figure 32--.

Column 6, lines 33 and 34, delete "FIG. 108" and insert --figure 108--.

Column 6, line 38, delete "FIG. 109" and insert --figure 109--.

Column 6, line 43, delete "FIG. 117" and insert --figure 117--.

Column 6, line 53, delete "FIG. 135" and insert --figure 135--.

UNITED STATES PATENT AND TRADEMARK OFFICE

CERTIFICATE OF CORRECTION

PATENT NO. : 4,917,644

DATED : April 17, 1990

INVENTOR(S) : Philip Sunshine

It is certified that error appears in the above-identified patent and that said Letters Patent is hereby corrected as shown below:

Column 6, line 59, delete "FIG. 149" and insert --figure 149--.

Signed and Sealed this

Twenty-fourth Day of September, 1991

*Attest:*

HARRY F. MANBECK, JR.

*Attesting Officer*

*Commissioner of Patents and Trademarks*